United States Patent [19]

Nastasi

[11] 4,131,229

[45] Dec. 26, 1978

[54] LOCK TOP FOR FOLDING CARTON

[76] Inventor: Guy Nastasi, 1251 Ash Ave., Bensenville, Ill. 60106

[21] Appl. No.: 844,925

[22] Filed: Oct. 25, 1977

[51] Int. Cl.[2] ..... B65D 5/10
[52] U.S. Cl. ..... 229/39 R
[58] Field of Search ..... 229/39 R, 38

[56] References Cited

U.S. PATENT DOCUMENTS

| | | | |
|---|---|---|---|
| 228,008 | 5/1880 | Wemzer | 229/39 R |
| 1,669,454 | 5/1928 | Close | 229/39 R |
| 2,186,777 | 1/1940 | Best | 229/39 R |
| 2,565,188 | 8/1951 | Welshenbach | 229/39 R X |
| 2,844,296 | 7/1958 | Soja | 229/39 R |
| 3,578,154 | 5/1971 | Martelli | 229/39 R |

FOREIGN PATENT DOCUMENTS

| | | | |
|---|---|---|---|
| 467469 | 3/1914 | France | 229/39 R |

*Primary Examiner*—Davis T. Moorhead
*Attorney, Agent, or Firm*—Darbo & Vandenburgh

[57] ABSTRACT

The closure for one end of a cardboard box comprises flaps extending respectively from opposite sides (at that end) and bent toward each other so that one flap overlies the other. The outer one of these two flaps has a longitudinal slot. The inner flap is cut and bent longitudinally to define a tab which extends through that slot and lies against the outer face of the outer of these two flaps. A third flap extends from a third side at the closure end of the box and is bent down to overlie the first two mentioned flaps and tab. The third flap has a tongue which extends into the box along side the first mentioned two flaps and is lockingly engaged therewith.

3 Claims, 6 Drawing Figures

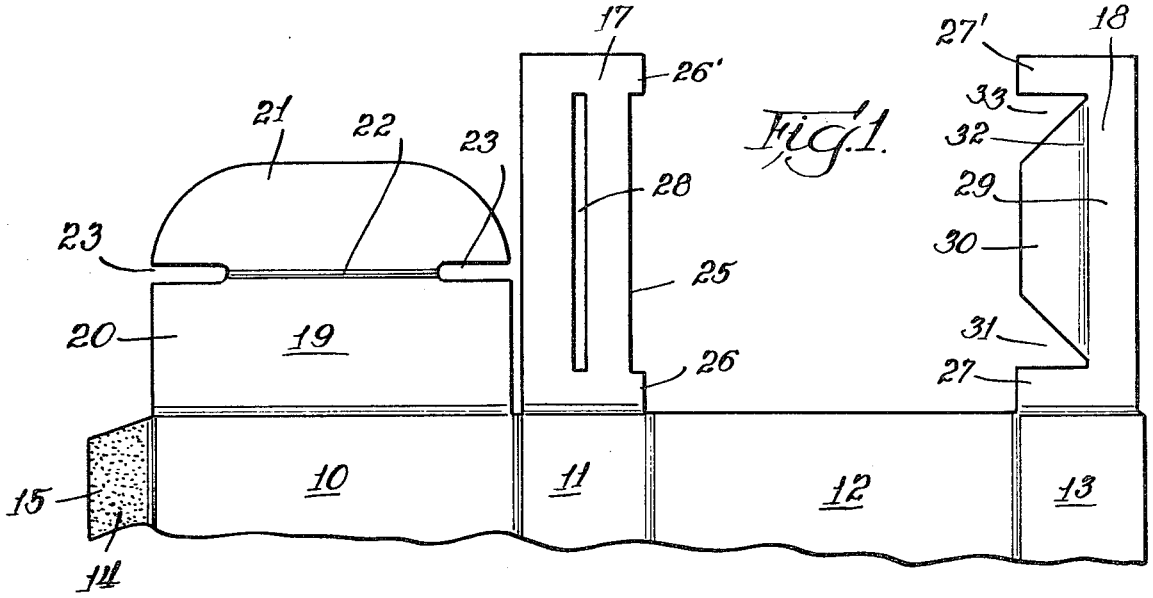
Fig. 1.
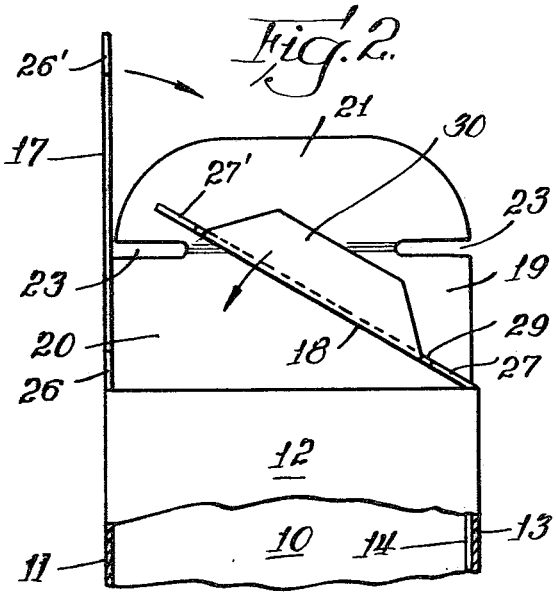
Fig. 2.
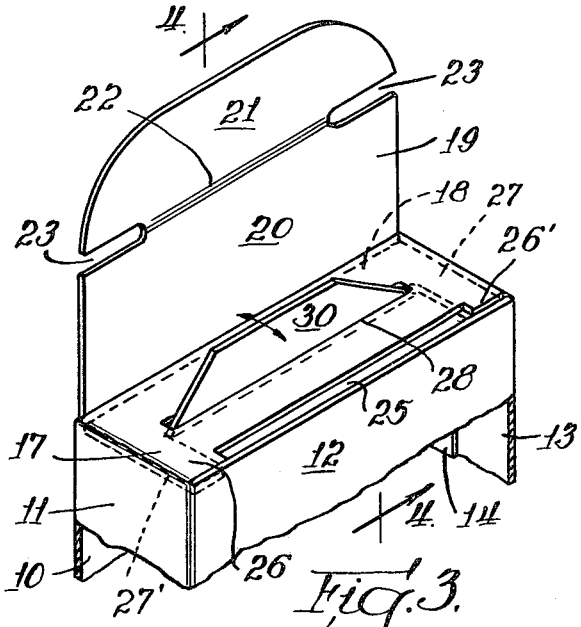
Fig. 3.
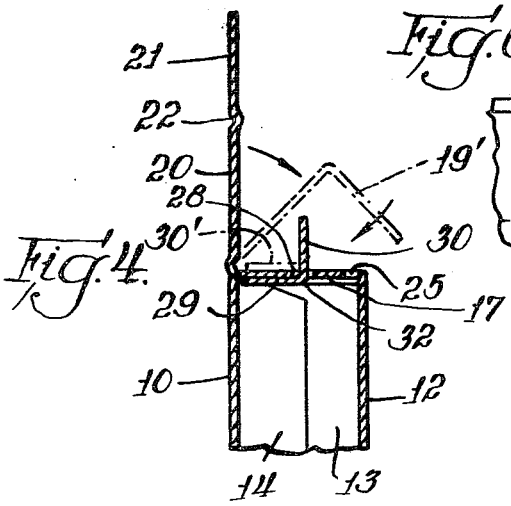
Fig. 4.
Fig. 6
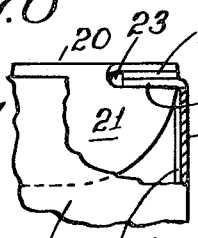
Fig. 5
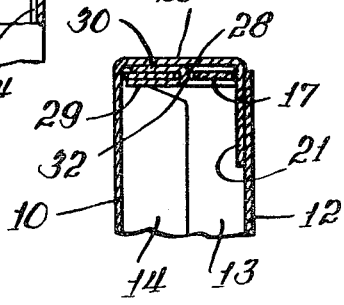

LOCK TOP FOR FOLDING CARTON

BACKGROUND AND SUMMARY OF THE INVENTION

This invention relates to boxes of chipboard or the like, supplied folded flat for filling and closing by means of side tabs and a top having a tongue that slides into the box and is provided with notches for locking the top in closed position. The invention is especially directed to such boxes in which the side tabs, as well as the top flap interlock to provide a more secure closure.

The object of the invention is to improve the side tab interlocking means to largely avoid the commonly experienced problem of tearing the portions of the side tabs intended to lock them together as the box is being closed so that a large proportion of the boxes are rendered useless and are discarded.

More specifically, the invention provides an interlocking arrangement which can be readily assembled without straining the box material and which securely locks the entire top closure structure together.

DESCRIPTION OF THE DRAWING

FIG. 1 is an outside view of a portion of a box blank incorporating the present invention;

FIG. 2 is a side view of a portion of a partially assembled box utilizing the blank of FIG. 1;

FIG. 3 is an isometric view of a portion of the box illustrated in FIG. 2 at a further stage of its assembly;

FIG. 4 is a sectional view as seen at line 4—4 of FIG. 3;

FIG. 5 is a sectional view corresponding to FIG. 4 but showing the end of the box in fully assembled condition; and FIG. 6 is a fragmentary view of a corner of the assembled box with a portion broken away.

DESCRIPTION OF SPECIFIC EXAMPLE

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The blank and assembled box comprises four panels or sides 10–13. The blank also includes a fifth flap 14 which is adhesively fixed to panel 13 (as by means of adhesive 15) so that in the assembled box it becomes a part of the box side defined by panel 13. In the assembled box there are two pair of opposed sides, one pair comprising panels or sides 11 and 13 and the other pair comprising panels or sides 10 and 12.

The closure for an end of the box includes a pair of flaps 17 and 18. Each of these extends from a respective one of the pair of sides 11, 13 and, when the box is closed, each extends toward the other of the sides of that pair of sides 11, 13. These two flaps overlie one another in the closed box and it is conventional to provide a means for interlocking these two flaps. As subsequently described herein, the present invention relates to such interlocking means.

A thrid flap 19 extends from one of the sides (i.e., side 10) of the other pair of sides 10, 12. It has a proximal portion 20 and a distal portion 21 forming a tongue. These are divided by a score line 22, to facilitate bending, and a pair of slots 23. In the closed box, the proximal portion 20 overlies the flaps 17, 18 and the distal portion or tongue 21 extends into the box and, at the slots 23, engages the flaps 17, 18 adjacent their proximal ends. This locking is achieved by the fact that flap 17 has a cutout 25 leaving an ear 26 at its proximal end. In the prior art flap 18 had a similar ear 27 adjacent its proximal end. When the distal portion 21 is inserted into the box it locks under (or inside of) ears 26 and 27 with those ears extending into slots 23.

As thus far described, the box structure is representative of a conventional box formed of cardboard or the like (e.g., flake board, plastic, etc.). As above mentioned, the present invention is primarily concerned with the structure for locking flaps 17 and 18 together. This structure will now be described.

Flap 17 has a longitudinal slot 28 centrally located therein. Flap 18 comprises a back portion 29 which extends the full length of the flap along one side thereof and a front portion along the other side of the flap which includes a locking tab 30. The demarcation between the back portion and the front portion is defined by a score line 32. The tab in the front portion also is set off by notches 31 and 33. The score line is used merely to facilitate the bending of the front portion with respect to the back portion at the proper location. At the score line, the tab 30 is of a length approximately corresponding to the length of slot 28. An ear 27′ extends from the end of the back portion of flap 18 as a part of the front portion thereof.

In the present embodiment, the flap 17 is sufficiently long to extend almost to the opposite side of the box. Thus the cutout recess 25 defines a second ear 26′ in that flap. The arrangement is such that the side of the ear 26 (which side is defined by recess 25) will line up with the side of ear 27′ (which side is defined by notch 33) in the assembled box. Likewise, the side of ear 27 will line up with the side of ear 26′ (those sides being defined by notch 31 and recess 25 respectively).

The manner in which the flaps are locked together when the end of the box is to be closed will be seen with reference to FIGS. 2–6. First, flap 18 is folded across the end of the box and with tab 30 projecting outwardly. FIG. 2 illustrates this movement being made. Next, flap 17 is folded across the end of the box so that its inner face lies against the outer face of flap 18. As this is being done, the tab 30 is inserted through the slot 28 in flap 17. FIGS. 3 and 4 illustrate the completion of that movement. Next, the tab 30 is bent, one way or the other, to lie against the outer face of flap 17. The dotted lines 30′ in FIG. 4 illustrate the tab 30 after having been bent back toward flap 19. However, the tab could be bent in the general direction toward panel 12. Thereafter, with its distal portion or tongue 21 bent at approximately right angles to the proximal portion 20, flap 19 is moved towards the first pair of flaps 17, 18, as illustrated by dotted line 19′ in FIG. 4. As this is being done, the tongue 21 is inserted through recess 25 and pressed downwardly against tab 30 and the outer face of flap 17. As this is being done, the tongue 21 slips past ears 26, 26′, 27 and 27′ and moves under (or inside of) those ears so that the ears extend into slots 23.

The box as thus closed is illustrated in FIGS. 5 and 6. The first pair of flaps 17, 18 are connected to opposite sides 11, 13, respectively, of the box. They are securely locked together by the back and front portions (29 and 30, respectively) of flap 18 lying against the inner and outer faces respectively of flap 17. Thus within the limits of the rigidity of the material employed for the box, the sides 11, 13 of the box are tied together by box material extending therebetween and forming a wall across the end of the box. Additionally, the flap 19 is locked to flaps 17 and 18, as well as being secured to the side 10. This not only adds strength to the end of the box (as in the prior art), but also holds the tab 30 in its folded position and thus the flap 18 into engagement with opposite sides of flap 17.

In the disclosed embodiment, flap 19 is locked (at slots 23) to flaps 17 and 18 both at the proximal and distal ends of the latter flaps, i.e., at ears 26, 26', 27 and 27'. This is advantageous because of the additional rigidity that the closed end of the box thereby provides. If such additional rigidity were not a requisite some of the ears could be dispensed with. For example, an embodiment could be made omitting ear 27', etc.

I claim:

1. In a folding box of cardboard or the like having two pair of opposed sides and a closure at one end which closure comprises a pair of flaps each extending from one side respectively of one of said pair of sides toward the other side of said one pair and a third flap extending from one side of the other pair toward the other side of said other pair, said third flap being outwardly of the pair of flaps, said third flap having latching means engaging at least one of said pair of flaps, said flaps having inner and outer faces, the improvement comprising:

a first of said pair of flaps having a longitudinal slot therein which slot is approximately centrally located in said one flap; and the other of said pair of flaps comprising a back portion and a front portion with a line of juncture therebetween, said front portion including a tab bent upwardly at said line of juncture, said back portion of said other flap lying in juxtaposition to the inner face of said first flap with said tab extending through said slot and lying in juxtaposition to the outer face of said first flap.

2. In a folding box as set forth in claim 1, wherein said third flap overlies said tab and holds it in juxtaposition to said outer face of said first flap.

3. In a folding box as set forth in claim 2 and wherein said third flap has slots therein adjacent said sides of said pair respectively and dividing said third flap into proximal and distal portions, and said flaps of said pair have ears adjacent the proximal ends thereof which ears extend into said slots respectively, said portions of said third flap at said slots forming said means engaging said pair of flaps, the further improvement comprising:

said pair of flaps having additional ears adjacent the distal ends of the flaps respectively, said additional ears also extending into said slots.

* * * * *